US006862821B2

(12) United States Patent
Parisotto

(10) Patent No.: US 6,862,821 B2
(45) Date of Patent: Mar. 8, 2005

(54) SPORTS SHOE SOLE

(75) Inventor: Davide Parisotto, Casella d'Asolo (IT)

(73) Assignee: Calzaturificio S.C.A.R.P.A. S.p.A., Asolo (IT)

( * ) Notice: Subject to any disclaimer, the term of this patent is extended or adjusted under 35 U.S.C. 154(b) by 0 days.

(21) Appl. No.: 10/167,333

(22) Filed: Jun. 11, 2002

(65) Prior Publication Data

US 2003/0019127 A1 Jan. 30, 2003

(30) Foreign Application Priority Data

Jun. 11, 2001 (EP) ..... 01830380

(51) Int. Cl.[7] ..... A43B 13/00; A43B 13/12; A43B 13/16

(52) U.S. Cl. ..... 36/59 R; 36/30 R; 36/88

(58) Field of Search ..... 36/59 R, 28, 30 R, 36/31, 32 R, 59 C, 88, 103, 107

(56) References Cited

U.S. PATENT DOCUMENTS 1,846,450 A * 2/1932 Packard ..... 36/30 R
4,213,255 A * 7/1980 Olberz et al. ..... 36/32 R
4,445,286 A * 5/1984 Norton ..... 36/32 R
4,890,398 A * 1/1990 Thomasson ..... 36/59 C
5,815,949 A * 10/1998 Sessa ..... 36/28
6,009,641 A * 1/2000 Ryan ..... 36/31
6,092,251 A * 7/2000 Tomat ..... 36/30 R
6,327,795 B1 * 12/2001 Russell ..... 36/28
6,412,196 B1 * 7/2002 Gross ..... 36/30 R
6,508,015 B1 * 1/2003 Rauch ..... 36/30 R

FOREIGN PATENT DOCUMENTS

WO WO 90/06699 * 6/1990 ..... A43B/13/18

* cited by examiner

*Primary Examiner*—Anthony Stashick
(74) *Attorney, Agent, or Firm*—Ladas & Parry LLP

(57) ABSTRACT

A sports shoe sole has a cushioning layer, a frame and a tread. The frame has through openings housing corresponding projections of the cushioning layer. The tread has a number of rocking locks located to correspond with the openings, and each having differently deformable portions located one in front of the other to provide uphill and downhill grip.

10 Claims, 2 Drawing Sheets

SPORTS SHOE SOLE

The present invention relates to a sports shoe sole, in particular for a light-hiking or trekking shoe.

BACKGROUND OF THE INVENTION

As is known, soles differ according to whether they are designed for comfort, safe footing or grip.

Light-hiking shoe soles are normally defined by two or more layers comprising at least one bottom layer or tread of elastomeric material, and a top layer of flexible cushioning material for supporting the foot.

When walking, the sole should ensure maximum grip on any surface or gradient, and in particular sufficient friction to prevent backward sliding uphill and ensure optimum braking downhill.

For this purpose, soles are now marketed featuring a tread with a number of deformable, projecting blocks, which are normally substantially quadrangular and constitute a compromise solution designed to achieve acceptable grip performance when accelerating and decelerating.

Currently marketed soles, however, fail to provide an optimum solution to the two conflicting requirements of ensuring safe footing, which would call for a substantially rigid sole, and a fairly good degree of comfort.

SUMMARY OF THE INVENTION

It is an object of the present invention to provide a sports shoe sole designed to solve the aforementioned problems, and which, in particular, provides for good grip combined with safe footing and comfort.

According to the present invention, there is provided a sports shoe sole as claimed in claim 1.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
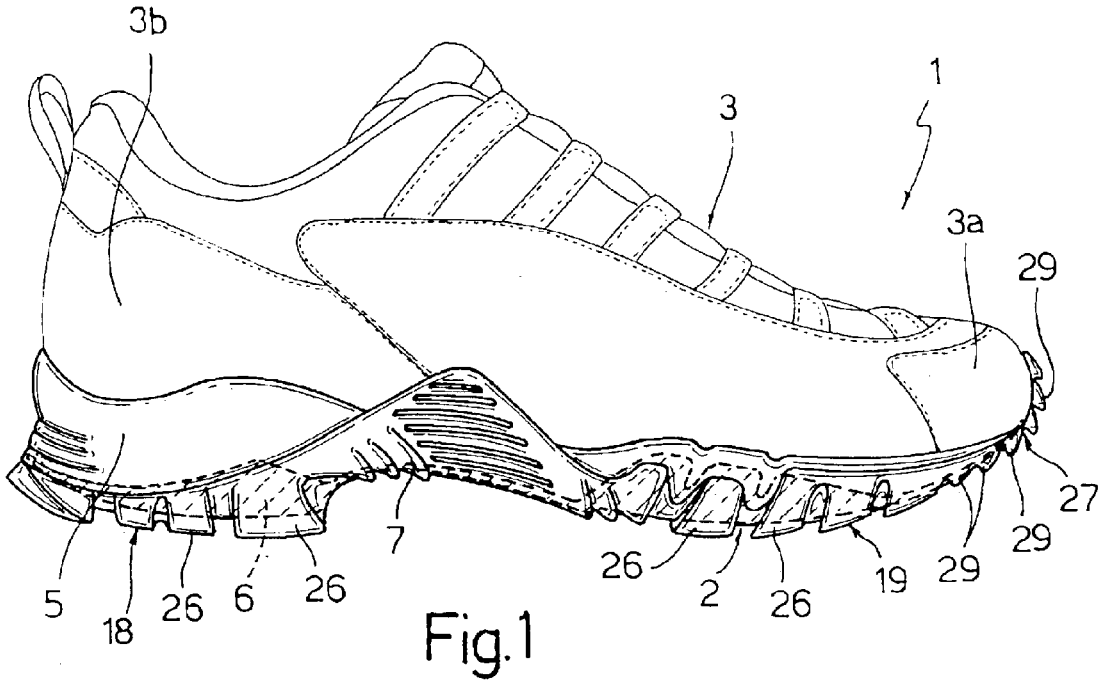
FIG. 1 shows a side view of a sports shoe comprising a sole in accordance with the present invention.
Figure 2:
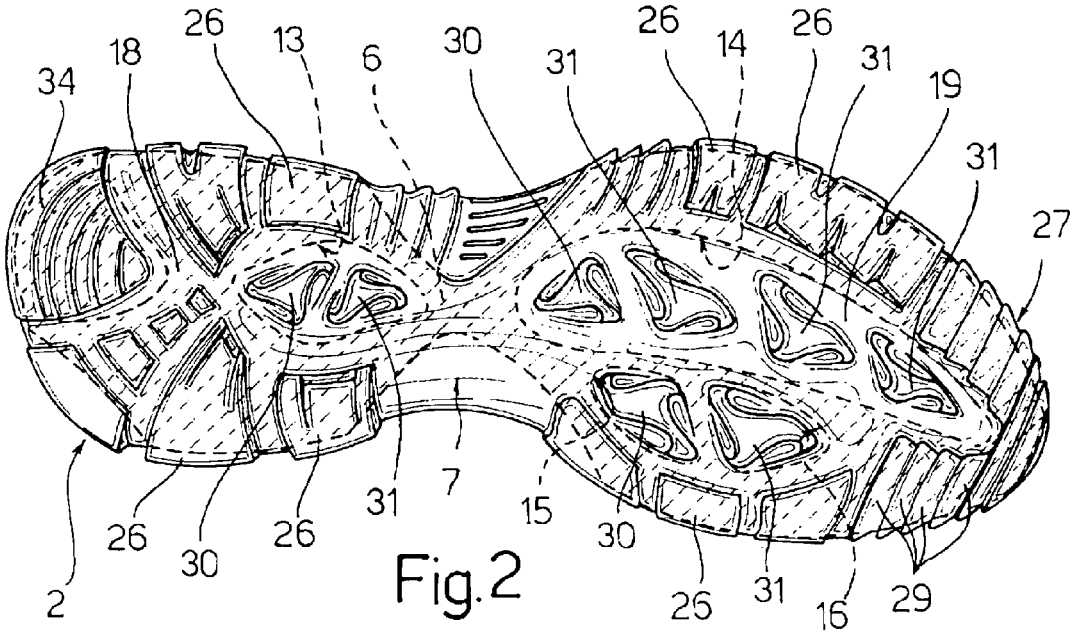
FIG. 2 shows an underside plan view of the FIG. 1 sole.

Number 1 in FIG. 1 indicates as a whole a light-hiking shoe comprising a sole 2 and a vamp 3.

Vamp 3 comprises a toe portion 3*a*, and a heel portion 3*b* corresponding with the heel of the wearer.

Figure 3:
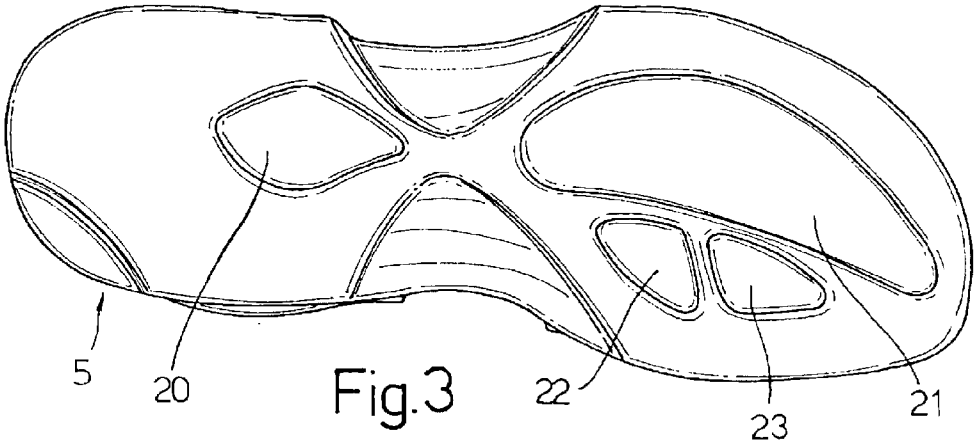
FIGS. 3, 4 and 5 show underside plan views of respective layers of the FIG. 1 sole.
Figure 4:
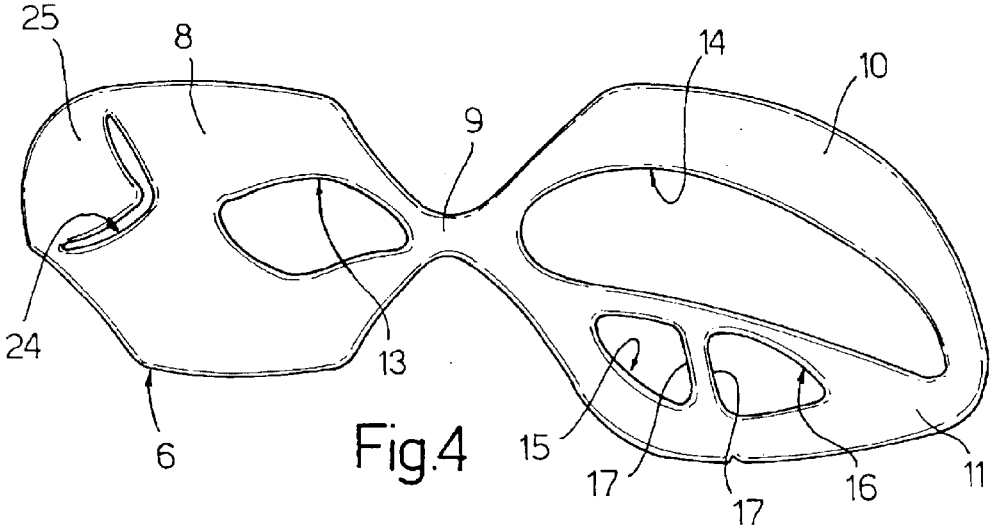
Figure 5:
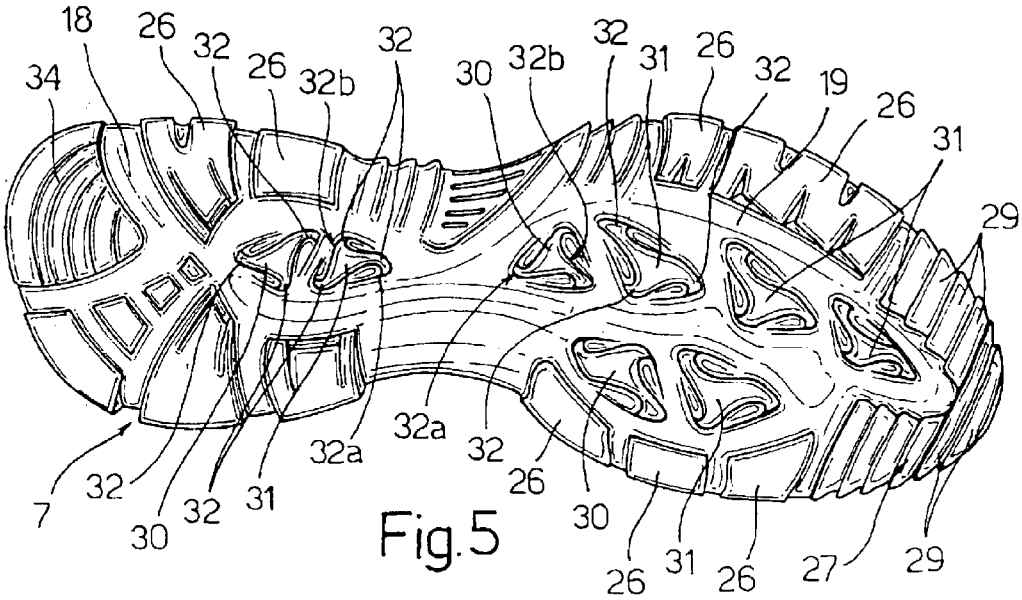

More specifically, and as shown in FIGS. 3, 4 and 5, sole 2 comprises a top or cushioning layer 5, an intermediate layer or frame 6, and a bottom layer or tread 7, placed and fixed, e.g. glued, one on top of another.

Cushioning layer 5 is made of relatively soft, flexible polymer foam material, preferably polyurethane foam, for effective shock absorption and comfortable support.

Frame 6 is made of thermoplastic material to provide the necessary mechanical strength—in particular, torsional rigidity—of sole 2.

Frame 6 (FIG. 4) is substantially figure-8-shaped, is slightly smaller in area than cushioning layer 5, and comprises a rear portion 8 at the heel, a narrow intermediate portion 9, and a front portion 10 at the forefoot.

Front portion 10 terminates at the front in a tapered toe portion 11 extending beneath the hallux to prevent bending fatigue of the metatarsus.

More specifically, rear portion 8 of frame 6 comprises an oblong middle first opening 13; and front portion 10 comprises an elongated middle longitudinal second opening 14, and two lateral openings 15, 16 located one (16) in front of the other (15) on the inner side of frame 6 with respect to second opening 14, and substantially triangular in shape with respective sides 17 substantially parallel and adjacent to each other.

Cushioning layer 5 comprises a number of bottom projections 20, 21, 22, 23 of the same shape and location as, and housed inside, openings 13, 14, 15, 16 of frame 6, so that, when fitted together, cushioning layer 5 and frame 6 define a continuous bottom surface on which to fix tread 7.

Frame 6 also comprises a slit 24 formed at the heel in rear portion 8, and substantially V-shaped with the vertex facing towards the toe of the shoe, so as to define a substantially triangular portion 25 located on the outer side of the heel and connected flexibly to the rest of rear portion 8 of frame 6.

Tread 7 is made of elastomeric material and forms, integrally, a heel 18 and a forefoot portion 19, both comprising a number of conventional, substantially quadrangular peripheral blocks 26.

Tread 7 also comprises a toe portion 27, which is connected to and extends beyond toe portion 11 of frame 6, is superimposed directly on a bottom portion of toe portion 3*a* of vamp 3, and in turn comprises a number of serrated scales 29.

According to the invention, tread 7 comprises two numbers of rocking blocks 30, 31 located to correspond with openings 13, 14, 15 and 16 of frame 6.

Each rocking block 30, 31 is substantially Y-shaped, i.e. triangular-shaped, with concave sides and lobes 32 enlarged at the vertices and all curving hookfashion in the same direction, e.g. clockwise when observing the sole from underneath.

Each rocking block 30 has one lobe 32 facing substantially rearwards, and two lobes 32 facing substantially frontwards; and each rocking block 31 has one lobe 32 facing substantially frontwards, and two lobes 32 facing substantially rearwards.

Each rocking block 30, 31 therefore has a more flexible portion 32*a* in the longitudinal portion comprising one lobe 32, and a less flexible portion 32*b* in the longitudinal portion comprising two lobes 32; and, by virtue of the different flexibility and relative locations of portions 32*a* and 32*b*, blocks 30 provide for downhill grip, and blocks 31 for uphill grip.

Moreover, flexing of blocks 30, 31 is assisted by their corresponding with openings 13, 14, 15 or 16, where tread 7 is connected directly to cushioning layer 5 as opposed to frame 6.

More specifically, from the heel to the toe, tread 7 comprises one block 30 and one block 31 at opening 13; one block 30 and three blocks 31 at opening 14; one block 30 at opening 15; and one block 31 at opening 16.

Tread 7 also comprises an asymmetrical triangular block 34 at portion 25 of frame 6.

When walking, block 34 is set first on the ground, and V-shaped slit 24 in frame 6 allows portion 25 of the frame, and hence block 34 fixed to portion 25, to flex to a greater extent than a conventional block.

The whole of heel 18 is then set down, so that blocks 30 and 31 corresponding with opening 13 are set down successively and, flexing in opposite directions, ensure firm grip both when decelerating (downhill) and accelerating (uphill). Finally, forefoot portion 19 is set down so that downhill-active blocks 30 grip first, followed by uphill-active blocks 31. Even when set completely on the ground, performance of the sole is therefore so balanced as to ensure firm grip in all dynamic and surface conditions.

At the end of each step, toe portion 27 of tread 7 comes into play to provide sufficient thrust to prevent losing grip at the uplift stage.

A firm foothold and additional grip are provided by peripheral blocks 26, which are substantially rigid as compared with rocking blocks 30, 31 and block 34.

The advantages of the sports shoe sole according to the present invention will be clear from the foregoing description.

In particular, being located at the openings in frame 6, rocking blocks 30, 31 deform more freely than conventional blocks and so adapt better to any type of surface.

The shape of the differently flexible blocks and the combined use of blocks rocking in opposite directions provide for ideal performance both up- and downhill. Using substantially rigid blocks in combination with rocking blocks provides for optimum grip and safety with no loss in comfort.

Clearly, changes may be made to the sports shoe sole as described herein without, however, departing from the scope of the accompanying claims.

In particular, changes may be made to the shape of the rocking blocks of tread 7 and the openings in frame 6. The mechanical stiffness of the sole may also be varied by changing the shape or material of frame 6. In particular, the torsional stiffness of the sole may be controlled by varying the width of intermediate portion 9 of the frame.

What is claimed is:

1. In a shoe sole (2) having a multilayer structure, the improvements comprising:

a top cushioning layer (5);

a bottom tread layer (7) of elastomeric material; and an intermediate frame layer (6) of material for ensuring necessary rigidity of said shoe sole (2) when said top cushioning layer (5), said intermediate frame layer (6) and said bottom tread layer (7) are superimposed and fixed to one another;

wherein said intermediate frame layer (6) has a number of through openings (13, 14, 15, 16); and wherein said bottom tread layer (7) has in one niece a heel portion, a forefoot portion located to correspond with said openings (13, 14, 15, 16) in said frame (6) upon said superposition, a number of rocking blocks (30, 31).

2. A sole as claimed in claim 1, characterized in that each said rocking block (30, 31) comprises a more flexible first portion (32*a*) and a less flexible second portion (32*b*); said portions being located one in front of the other in a longitudinal direction with respect to the sole (2).

3. A sole as claimed in claim 2, characterized by comprising a first number of rocking blocks (31), each having said first portion (32*a*) in front of said second portion (32*b*) to achieve optimum grip uphill; and a second number of rocking blocks (30), each having said first portion (32*a*) behind said second portion (32*b*) to achieve optimum grip downhill.

4. A sole as claimed in claim 1, characterized in that said rocking blocks (30, 31) are substantially triangular with concave sides and lobes (32) enlarged at the vertex portions; said first portion (32*a*) of each said rocking block (30, 31) being defined by one lobe (32); and said second portion (32*b*) being defined by two side by side said lobes (32).

5. A sole as claimed in claim 1, characterized in that said cushioning layer (5) has a number of projections (20, 21, 22, 23) housed in respective said openings (12, 14, 15, 16) in said intermediate frame layer (6).

6. A sole as claimed in claim 1, characterized in that said intermediate frame lever (6) comprises a V-shaped slit (24) located in an outer portion of the heel (18) of the shoe (1); and in that the vertex of the V faces the toe of said shoe (1) so as to define a portion (25) of the intermediate frame layer (6) connected flexibly to the rest of said intermediate frame layer (6).

7. A sole as claimed in claim 6, characterized in that said bottom tread layer (7) comprises a substantially triangular block (34) fixed to said portion (25) of said intermediate frame layer (6).

8. A sole as claimed in claim 1, characterized in that said bottom tread layer (7) comprises a toe portion (27) having a number of serrated scales (29).

9. A shoe sole having a multilayer structure comprising a top cushioning layer (5), an intermediate frame layer (6) made of material ensuring the necessary rigidity of said sole (2) and a bottom tread layer (7) made of elastomeric material, said top cushioning layer (5), said intermediate flame layer (6) and said bottom tread layer (7) being superimposed and fixed to one another, said intermediate frame layer (6) having a number of through openings (13, 14, 15, 16), said bottom tread lave integrally forming a heel portion and a forefoot portion and having a number of blocks which project from portions of said bottom tread layer facing said through openings (13, 14, 15, 16) in said intermediate frame layer (6) and are adapted to rock upon contact with the ground.

10. A shoe sole having a multilayer structure comprising a top cushioning layer (5), an intermediate frame layer (6) made of material ensuring the necessary rigidity of said sole (2) and a bottom tread layer (7) made of elastomeric material, said top cushioning layer (5), said intermediate frame layer (6) and said bottom tread layer (7) being superimposed and fixed to one another, said intermediate frame layer (6) having a number of openings (13, 14, 15, 16), said bottom tread layer integrally forming a heel portion and a forefoot joint and having a number of rocking blocks which project from portions of said bottom tread layer in direct contact with said top cushioning layer through said openings (13, 14, 15, 16).

* * * * *